US005518798A

United States Patent [19]

Riedel

[11] Patent Number: 5,518,798

[45] Date of Patent: May 21, 1996

[54] MATERIAL TRANSMITTING SUNLIGHT AND BATHING WEAR AND LIGHT-PROTECTIVE WEAR MADE FROM THE SAME

[75] Inventor: Herbert Riedel, Marktleugast, Germany

[73] Assignee: Solar-Fashion GmbH & Co. KG., Bindlach, Germany

[21] Appl. No.: 162,070

[22] PCT Filed: Apr. 28, 1993

[86] PCT No.: PCT/EP93/01024

§ 371 Date: Dec. 9, 1993

§ 102(e) Date: Dec. 9, 1993

[87] PCT Pub. No.: WO94/01010

PCT Pub. Date: Jan. 20, 1994

[30] Foreign Application Priority Data

Jul. 9, 1992 [DE] Germany ..... 42 22 582.5

[51] Int. Cl.[6] ..... A41D 5/00; D06P 5/00; B32B 7/00; D03D 3/00

[52] U.S. Cl. ..... 428/135; 2/67; 8/478; 8/483; 66/171; 66/189; 428/131; 428/134; 428/220; 428/231; 428/229; 428/253; 428/255

[58] Field of Search ..... 66/169 R, 170, 66/171, 195, 192, 202, 189; 428/229, 231, 253, 297, 373, 377, 131, 134, 135, 220, 255, 219; 2/67; 8/478, 483

[56] References Cited

U.S. PATENT DOCUMENTS

| | | | |
|---|---|---|---|
| 3,070,870 | 1/1963 | Alexander et al. | 28/74 |
| 3,389,582 | 6/1968 | Alexander . | |
| 3,922,888 | 12/1975 | Patterson | 66/192 |
| 3,931,721 | 1/1976 | Adamson | 66/195 |
| 3,940,917 | 3/1976 | Strachan | 57/152 |
| 4,546,493 | 10/1985 | Bortnik . | |
| 4,748,078 | 5/1988 | Doi et al. | 428/245 |

FOREIGN PATENT DOCUMENTS

| | | |
|---|---|---|
| 1209072 | 10/1959 | Germany . |
| 1760606 | 9/1972 | Germany . |
| 59-150142 | 8/1984 | Japan . |
| 492412 | 8/1970 | Switzerland . |

*Primary Examiner*—James D. Withers
*Attorney, Agent, or Firm*—Michael J. Striker

[57] ABSTRACT

A bathing wear is made of a net-like knitted fabric printed with contrasting bright colors, composed of 73% nylon and 27% of a polyurethane elastomer. The knitted fabric has a multiplicity of hexagonal mesh openings, which are aligned in rows in three directions. This bathing wear allows about two-thirds of the incident UV radiation of the sun to pass and thus gives rise to full body tanning, without being transparent however even when wet. In addition, the bathing wear is quick-drying and fits the body elastically.

19 Claims, 4 Drawing Sheets

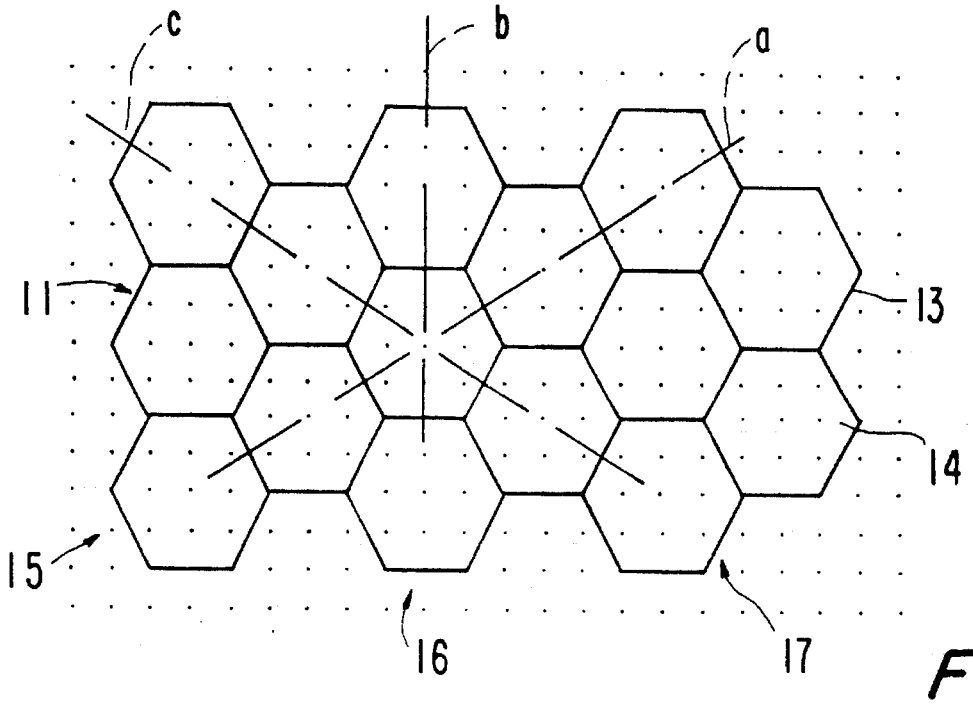
FIG. 4
FIG. 5
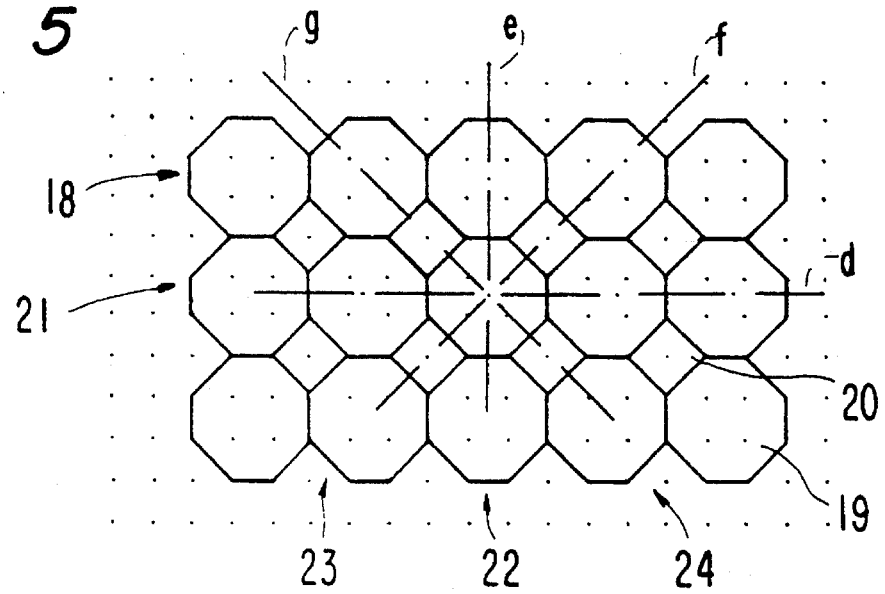

MATERIAL TRANSMITTING SUNLIGHT AND BATHING WEAR AND LIGHT-PROTECTIVE WEAR MADE FROM THE SAME

BACKGROUND OF THE INVENTION

This invention relates to a material transmitting sunlight, especially for bathing wear or light-protective clothing, consisting of a net-like, knitted fabric with mesh openings which is printed with contrasting bright colors and cannot therefore be seen through when put on the skin.

Such a material as well as bathing wear made therefrom are already known. Such a bathing suit or bikini has the advantage that even the parts of the body clad therewith tan in the sun, even although they are covered as with conventional bathing wear and are not visible. This bathing wear therefore facilitates tanning substantially free from demarcations in sunny weather, without the need for nude bathing or seeking out a bathing beach provided therefor or suitable country.

The known bathing wear involves a printed net-like knitted fabric of cotton. This is really only suitable for pure sun bathing and not for swimming. If this bathing wear gets wet its opacity is no longer fully guaranteed. The wet bathing wear also dries comparatively badly, which reduces the wearing comfort or requires a change of clothes. Moreover the adaptability to the body and the fit depending thereon leave something to be desired, especially after many wearings or long life.

SUMMARY OF THE INVENTION

The invention is accordingly based on the object of so improving the material initially described that the clothing produced therefrom combines optimum tanning properties and a cladding action which is not reduced by wetness with enhanced hang and wearing comfort.

This object is met according to the invention in the knitted fabric consists of polyamide fibres and a polyurethane elastomer and has a honeycomb-like structure with rows of mesh openings which extend in at least three angularly offset directions.

The material according to the invention is very elastic and able to stretch because of the components of the knitted fabric and its honeycomb structure, moreover in at least three and even four directions. This leads to an enhanced ability to adapt to the shape of the body, whereby the polygonal (hexagonal) mesh openings correspondingly widen out when being worn, so that the sun's rays and thus the UV rays leading to tanning of the skin can penetrate well. At the same time, the knitted fabric lying against the body remains opaque because of the printing with contrasting bright colours, moreover even when the knitted fabric is wet. Furthermore the wet material dries particularly rapidly, for which not only the fibres employed but also the loose structure of the appropriately light knitted fabric are responsible. Accordingly, appropriate bathing wear is suitable for both sun bathing and swimming.

The knitted fabric can be composed of 60% to 80% polyamide fibers and 20% to 40% polyurethane elastomer, preferably of 73% polyamide fiber and 27% polyurethane elastomer. The knitted fabric can have a mass per unit area of 120–200 g/m$^2$, preferably 160 g/m$^2$. The mesh openings can have a clear mesh opening with amounting to 0.2–1.0 mm, preferably 0.5 mm.

Investigations with a knitted fabric having hexagonal mesh openings of uniform size of 73% nylon and 27% polyurethane in thread counts of 40 denier and 280 denier respectively with a mass per unit area of 160 g/m$^2$ have shown that the knitted fabric allows through about 65% of the UV rays of the sun or in other words shields the body from about ⅓ of the UV radiation. This corresponds approximately to the use of a sun cream with a light-protection factor of 10 on the bare skin. Thus the material according to the invention is not only specially suitable for bathing wear but is also of general advantage when the skin is to be protected from over-strong sun radiation without the use of sun creams, which are made on a fat or oil basis, while a tanning effects is definitely desired. Numerous different kinds of articles of clothing offer themselves as such light-protective clothing, for example T-shirts, leggings, cycling trousers and Capri trousers. It is conceivable that printing in contrasting colors can then be omitted at least partially, if desired.

In a preferred embodiment of the invention the knitted fabric according to the invention consists of nylon and polyurethane elastomer.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 4 shows the closely adjacent hexagonal mesh openings of the knitted fabric forming the material in a further enlarged illustration of principle; and FIG. 5 shows an illustration of principle corresponding to FIG. 4 of knitted fabric with other mesh openings.

DESCRIPTION OF PREFERRED EMBODIMENTS

Figure 1:
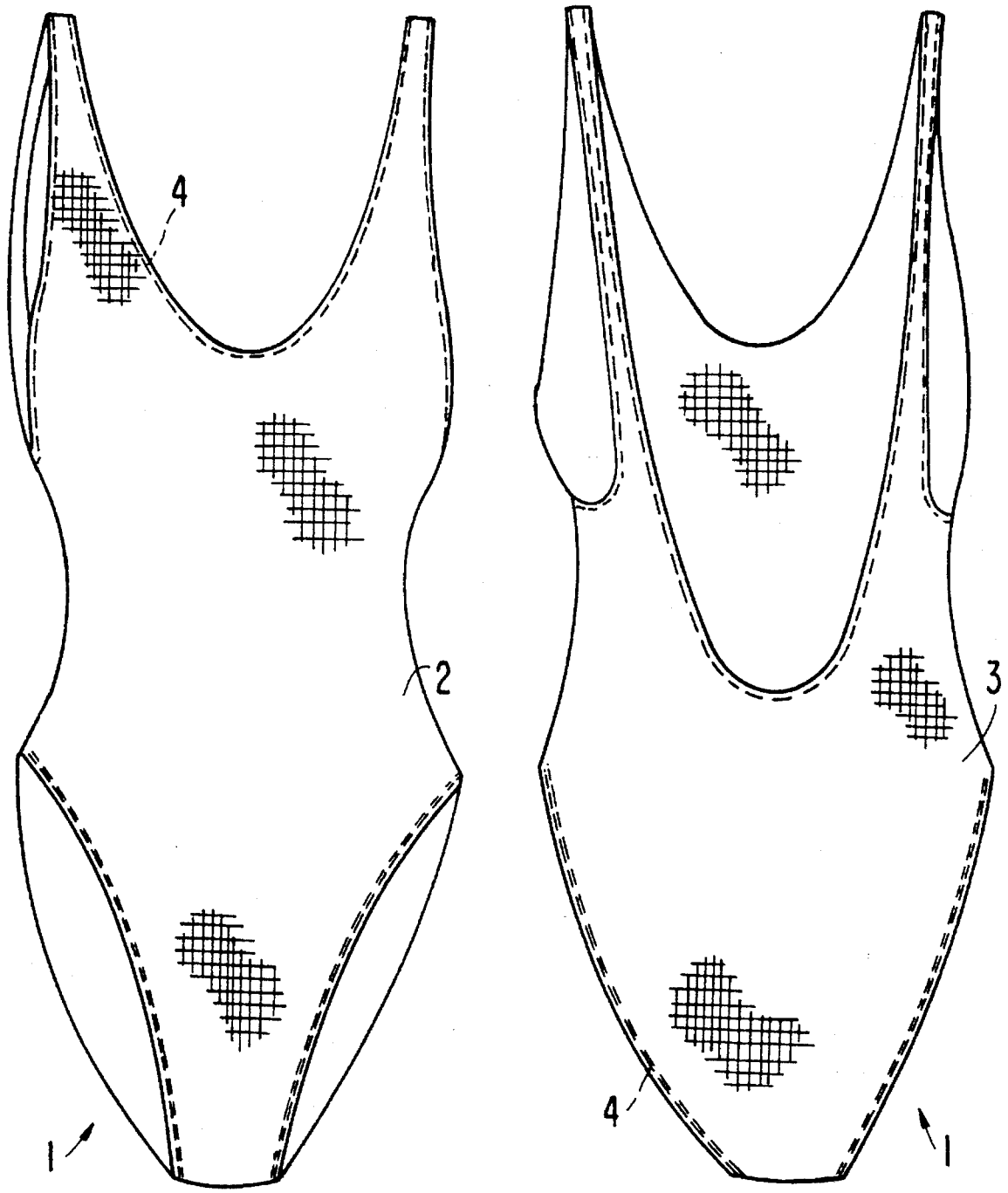
FIG. 1 shows a bathing suit from the front and the rear.

FIG. 1 shows a bathing suit 1 with a front side 2 and a rear side 3. As indicated in broken lines, the leg openings, the neck opening and the armholes are provided in known manner with an elastic hem 4 using an overlock seam.

Figure 2:
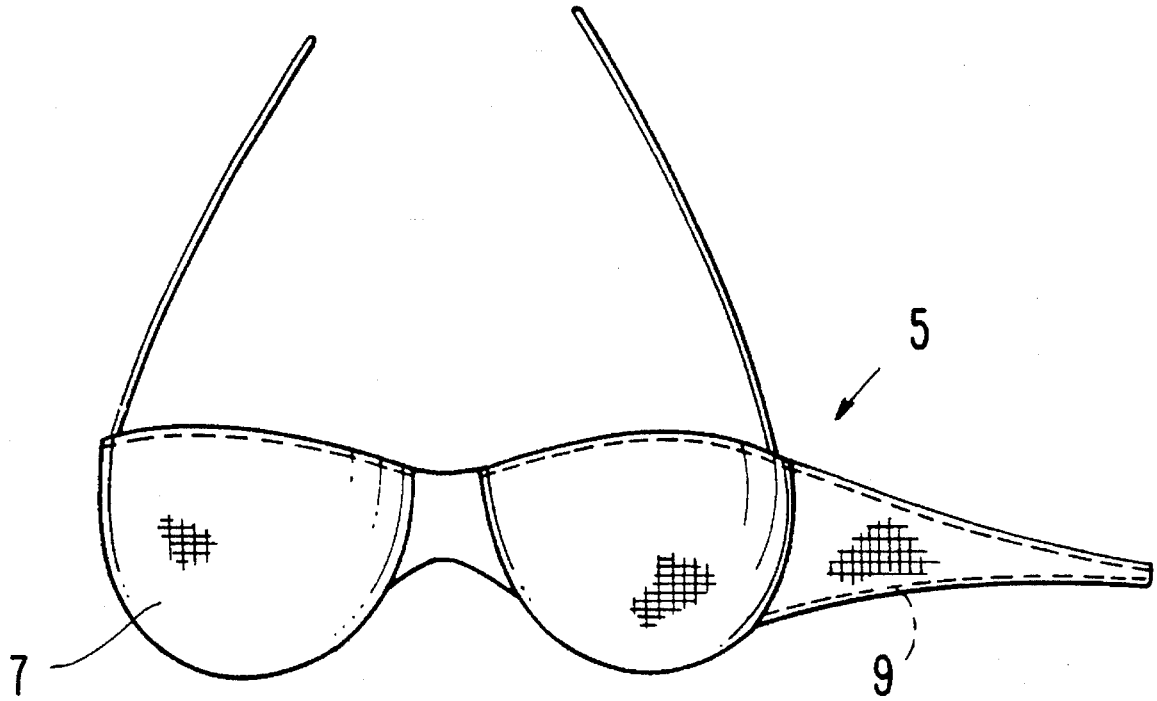
FIG. 2 shows a bikini in front view.
Figure 2:
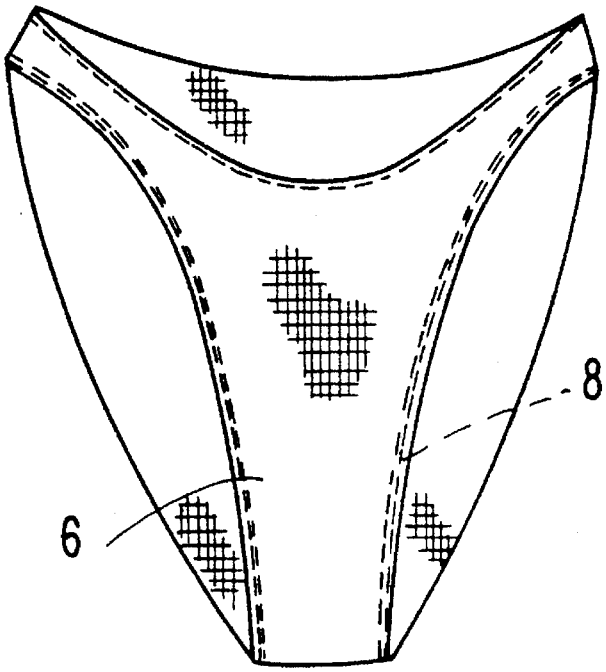

FIG. 2 shows a bikini 5 with bikini shorts 6 and a top part 7. Elastic hems 8 and 9 are provided here also.

Both the bathing suit 1 and the bikini 5 are formed and made up in the usual way. The distinctiveness lies only in the material used in their manufacture from which the specific advantages in use result.

Figure 3:
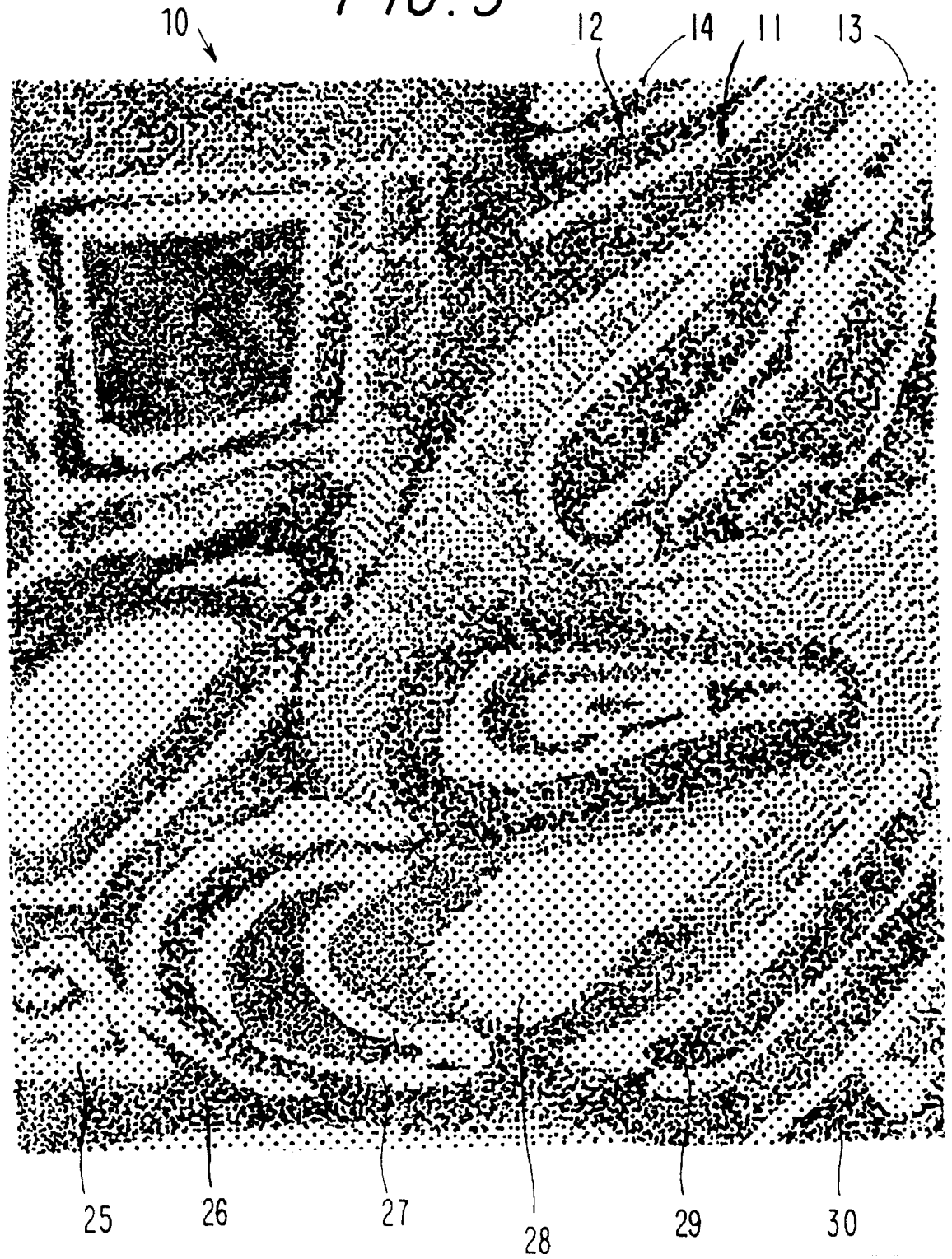
FIG. 3 shows an enlarged section of the printed material used for the bathing wear.

FIG. 3 shows this material 10 in a sectional enlargement, relating to a knitted fabric 11 with printing 12.

In FIG. 3 the structure of the knitted fabric 11 can be seen in the region of light colored printing, since the material 10 is represented on a dark background. It involves a net-like knitted fabric 11 which is made from a two-thread yarn 13 and has a multiplicity of closely adjacent mesh openings 14. In the representation in FIG. 3 the material 10 is in the worn state of light stretching so that the mesh openings 14 are partially opened to varying extents and the mesh opening rows do not stand out clearly everywhere. It should however by noted that the mesh openings 14 have a hexagonal shape and are arranged in three roves of mesh openings angularly offset from one another.

This situation is shown more clearly in FIG. 4. This illustration of the principle superimposed on a grid of points makes it clear that the mesh openings 14 of the machine made knitted fabric 11 are not exactly regular hexagons because the two horizontally running edges are somewhat shorter than the other four edges. The fact that each mesh opening 14 pertains to three rows 15, 16 and 17 of mesh openings can be seen well, these extending in three directions a, b, c angularly offset from one another. Adjacent mesh openings 14 of a row have a narrow edge boundary formed in common from the yarn 13.

The yarn 13 used to make the net-like knitted fabric 11 comprises—not shown in the Figures—a thicker nylon thread with a count of about 40 denier and a thinner thread with a count of about 280 denier of a polyurethane elastomer (Lycra). This corresponds to a yarn composition of 73% nylon and 27% Lycra. The specific weight of the knitted fabric 11 amounts to 160 g/m$^2$. The clear mesh opening width amounts to about 0.5 mm in the state not widened out by wearing.

Because of the structure of the knitted fabric 11, the yarn components employed and a special finish, the material 10 is very elastic and able to stretch in many directions. This ensures a permanent good fit of the bathing wear 1 or 5 and widening or modification of the mesh openings 14 during wear or from body movements. The body thus experiences irradiation substantially all over in the sun with about 65% of the incident UV rays. In the region of the hems 4 or 8, 9 the tanning effect can be improved by slight shifting of the seam on the skin from time to time.

FIG. 5 illustrates the fact that a knitted fabric 18 can be used with different mesh openings 19 and 20, namely octagonal larger mesh openings 19 and square smaller mesh openings 20, the larger mesh openings 19 being arranged in four rows 21 to 24 of mesh openings, which extend in four directions d, e, f, g which are at 45° to each other—i.e. with a uniform angular offset. In this case also there results a material which is elastic and able to stretch in four directions, with good tanning properties.

The printing 12 is effected with contrasting bright colours. For example six (possibly even more) different bright colors 25 to 30 are used, which contrast with each other. It can be seen from FIG. 3 that the printed design provides comparatively small areas of the same color, so that there is not only intensive coloration but also a strongly changing coloration. This results in the impression for human eyes that the material 10 which lies on the skin and is thus not lit through is not a net with a large proportion of its area in openings but is a dense material.

I claim:

1. A sunlight transmitting material, comprising a mesh knitted fabric provided with a plurality of mesh openings, said knitted fabric being printed with contrasting bright colors so as not to be seen through when put on a skin, said knitted fabric consisting of polyamide thread and polyurethane elastomer thread, said knitted fabric having a honeycomb-like structure with rows of said mesh openings extending in at least three angularly offset directions and said mesh openings having a clear mesh opening width of from 0.2 to 1.0 mm so as to permit tanning of the skin covered by the sunlight transmitting material.

2. A sunlight transmitting material as defined in claim 1, wherein said mesh openings are substantially hexagonal and arranged in said rows of mesh openings which extend in three angularly offset directions.

3. A sunlight transmitting material as defined in claim 1, wherein all said mesh openings have a substantially same shape and size.

4. A sunlight transmitting material as defined in claim 1, wherein said mesh openings are arranged in rows of mesh openings extending in four directions offset from one another.

5. A sunlight transmitting material as defined in claim 1, wherein said knitted fabric consists of nylon and polyurethane elastomer.

6. A sunlight transmitting material as defined in claim 1, wherein said knitted fabric is composed of 60% to 80% polyamide fibers and 20% to 40% polyurethane elastomer.

7. A sunlight transmitting material as defined in claim 6, wherein said knitted fabric is composed of substantially 73% polyamide fiber and substantially 27% polyurethane elastomer.

8. A sunlight transmitting material as defined in claim 1, wherein said knitted fabric has a mass per unit area of 120 to 200 g per m$^2$.

9. A sunlight transmitting material as defined in claim 8, wherein said knitted fabric has a mass per unit area of 160 g per m$^2$.

10. A sunlight transmitting material as defined in claim 1, wherein said mesh openings have a clear mesh opening width amounting to substantially 0.5 mm.

11. A bathing wear formed of a sunlight transmitting material comprising a mesh knitted fabric provided with a plurality of mesh openings, said knitted fabric being printed with contrasting bright colors so as not to be seen through when put on a skin, said knitted fabric consisting of polyamide thread and polyurethane elastomer thread, said knitted fabric having a honeycomb-like structure with rows of said mesh openings extending in at least three angularly offset directions and said mesh openings having a clear mesh opening width of from 0.2 to 1.0 mm so as to permit tanning of the skin covered by the sunlight transmitting material.

12. A bathing wear as defined in claim 11, wherein the bathing wear is formed as a bathing suit.

13. A bathing wear as defined in claim 11, wherein the bathing wear is formed as a bikini.

14. A bathing wear as defined in claim 11, wherein the bathing wear is formed as bathing trunks.

15. A light-protective clothing formed of a sunlight transmitting material comprising a mesh knitted fabric provided with a plurality of mesh openings, said knitted fabric being printed with contrasting bright colors so as not to be seen through when put on a skin, said knitted fabric consisting of polyamide thread and polyurethane elastomer thread, said knitted fabric having a honeycomb-like structure with rows of said mesh openings extending in at least three angularly offset directions and said mesh openings having a clear mesh opening width of from 0.2 to 1.0 mm so as to permit tanning of the skin covered by the sunlight transmitting material.

16. A light-protective clothing as defined in claim 15, wherein the light protective clothing is formed as a T-shirt.

17. A light-protective clothing as defined in claim 15, wherein the light protective clothing is formed as leggings.

18. A light-protective clothing as defined in claim 15, wherein the light-protective clothing is formed as cycling trousers.

19. A light-protective clothing as defined in claim 15, wherein the light-protective clothing is formed as Capri trousers.

* * * * *